US006020112A

United States Patent [19]

Twist

[11] Patent Number: 6,020,112

[45] Date of Patent: Feb. 1, 2000

[54] METHOD FOR RAPID PHOTOGRAPHIC PROCESSING WITH MAINTAINED COLOR BALANCE

[75] Inventor: Peter J. Twist, Gt. Missenden, United Kingdom

[73] Assignee: Eastman Kodak Company, Rochester, N.Y.

[21] Appl. No.: 09/176,503

[22] Filed: Oct. 21, 1998

[51] Int. Cl.[7] ..... G03C 7/407

[52] U.S. Cl. ..... 430/380; 430/361; 430/436; 430/440

[58] Field of Search ..... 430/361, 380, 430/436, 440

[56] References Cited

U.S. PATENT DOCUMENTS

| | | | |
|---|---|---|---|
| 4,155,763 | 5/1979 | Hasebe et al. | 430/469 |
| 4,266,002 | 5/1981 | McCreary et al. | 430/218 |
| 4,272,613 | 6/1981 | Shibaoka et al. | 430/380 |
| 4,394,440 | 7/1983 | Cappel | 430/379 |
| 4,465,762 | 8/1984 | Ishikawa et al. | 430/476 |
| 4,483,919 | 11/1984 | Kobayashi et al. | 430/566 |
| 4,546,068 | 10/1985 | Kuse | 430/380 |

FOREIGN PATENT DOCUMENTS

| | | |
|---|---|---|
| 0 561 860 B1 | 11/1995 | European Pat. Off. . |
| 62 178 251 | 8/1987 | Japan . |

*Primary Examiner*—Hoa Van Le
*Attorney, Agent, or Firm*—J. Lanny Tucker

[57] ABSTRACT

Color photographic papers can be more rapidly color developed (up to 25 seconds) in the presence of a color developing solution containing a 3-pyrazolidone electron transfer agent. Despite the shortened processing time, color balance within the three color records of such color papers is maintained.

20 Claims, 3 Drawing Sheets

METHOD FOR RAPID PHOTOGRAPHIC PROCESSING WITH MAINTAINED COLOR BALANCE

COPENDING APPLICATIONS

Copending and commonly assigned U.S. Ser. No. 09/176,529, filed on even date herewith by Twist and Goddard, and entitled "A Method for Rapid Photographic Processing With Maintained Color Balance Using Diffusible Photochemicals".

FIELD OF THE INVENTION

This invention relates to a method of processing color photographic papers in a rapid fashion without loss in color balance among the color records

BACKGROUND OF THE INVENTION

Multicolor, multilayer photographic elements are well known in the art. Such materials generally have three different selectively sensitized color records having one or more silver halide emulsion layers coated on one side of a single support. Each color record has components useful for forming a particular color in an image. Typically, the materials utilize color forming couplers or dyes in the sensitized layers during processing.

One commercially important type of color photographic elements are what are known as color prints. These elements are used to display images captured by a camera user on photographic color negative films. There is continuing interest in the industry to provide color print images more rapidly so the customers have a smaller wait from the time the color negative films are submitted for processing to the time they receive the color prints.

In color paper processing, the conventional order of the light sensitive color records on a support is a blue-sensitive silver halide emulsion layer nearest the support, a green-sensitive silver halide emulsion layer next to it, and a red-sensitive silver halide emulsion layer as the topmost light sensitive layer. It has been observed that the blue-sensitive emulsion layer is the slowest to achieve aim sensitometry, generally because it is the last layer to receive processing chemicals. Most color papers are designed in the various layers to take this into account and to provide desired correct color balance among the color records using standard processing conditions and times.

Pyrazolidone compounds are commonly used as black and white developing agents. They have also been incorporated as electron transfer agents into color photographic materials for various purposes, color development activity, as described in U.S. Pat. No. 4,266,002 (McCreary et al) and U.S. Pat. No. 4,465,762 (Ishikawa et al). Moreover, in EP 0 561 860B 1 (Twist) describes the use of pyrazolidones either in color photographic materials or color developers in order to reduce variabilities in sensitometric properties. Processing in this context is under standard times and temperatures. For example, color development was varied from 1 to 8 minutes. In U.S. Pat. No. 4,155,763 (Hasebe et al), 3-pyrazolidone derivatives are incorporated into color developing solutions for various purposes including alleged rapid color development. However, only color development at the relatively slow 60 seconds is shown.

However, as noted above, there is a need to reduce processing time, and particularly to reduce color development time. When conventional color papers are color developed in reduced times, for example, for less than 25 seconds, the red-sensitive color record is generally over developed and the blue-sensitive color record is underdeveloped. Reformulation of the conventional color developer chemicals to decrease activity in the red-sensitive color record towards the aim sensitometry only makes the blue-sensitive color record move lower and further from aim sensitometry. Reformulation of the conventional color developer chemicals to increase activity in the blue-sensitive color record towards aim sensitometry only makes the red-sensitive record move higher and further from aim sensitometry. Thus reformulation of the conventional color developer chemicals has not resulted in a solution to this problem and for short color development times, existing color papers give prints with unacceptable color balance. Moreover, it is not practical to change the color papers encountered in the trade, especially since they are available from several manufacturers.

Thus, there is a need to provide aim color balance in color photographic silver halide papers without reengineering the color papers or adversely affecting the color developing composition, no matter what time is used for color development. In particular, it is desired to achieve aim color balance during rapid color development.

SUMMARY OF THE INVENTION

An advance in the art is provided with a method of forming a color photographic image comprising:

A) contacting an imagewise exposed color silver halide photographic paper with a color developing composition comprising a color developing agent, and a 3-pyrazolidone electron transfer agent in an amount of at least 0.2 mmol/l, the contacting being for up to 25 seconds, the photographic paper comprising a support having thereon, in order, a blue-sensitive photographic silver halide emulsion layer, a green-sensitive photographic silver halide emulsion layer, and a red-sensitive photographic silver halide emulsion layer, wherein desired color balance among all three silver halide emulsion layers is maintained.

It was surprising that incorporating a 3-pyrazolidone compound into the color developing composition provided desired color balance and sensitometric properties even when color development was carried out within 25 seconds. The blue-sensitive emulsion layers (or color record) are appropriately developed and the outermost red-sensitive emulsion layers (or color record) are not overdeveloped. This was surprising because such 3-pyrazolidone compounds are known to be development accelerators, and it was expected that color development would have been accelerated in all of the photosensitive color records. Instead, it was observed that color development was accelerated in the blue-sensitive color record, but simultaneously inhibited in the red-sensitive color record. Thus, appropriate color balance is achieved during more rapid processing of color photographic papers without changing the color papers themselves, and without considerable reformulation of the color developing composition.

The present invention provides for effective and rapid color development of current or commercially available photographic color papers. Thus, the current commercial color silver halide papers can be processed using either the conventional processing or the rapid process of this invention.

DETAILED DESCRIPTION OF THE INVENTION

Figure 1:
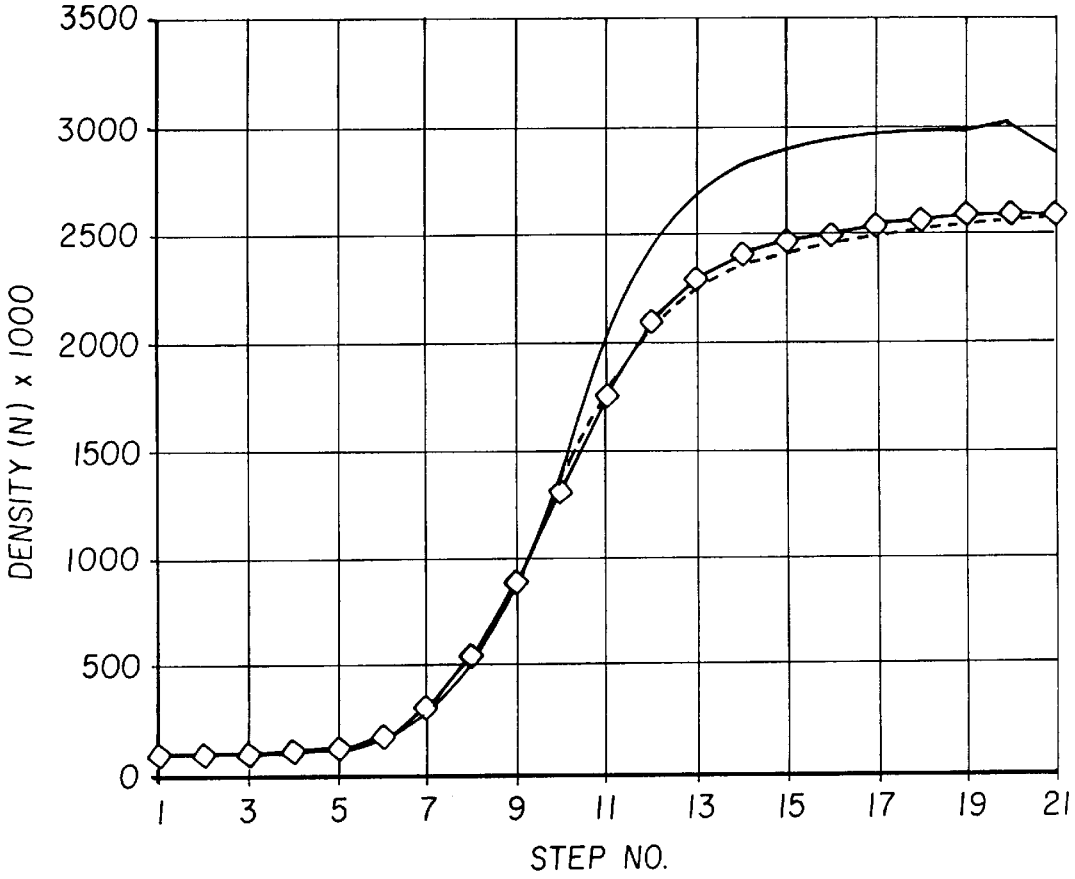
FIG. 1 is a graphical plot of sensitometric results in the red-sensitive color record of the processed color papers as described in Example 2 below.

The 3-pyrazolidone electron transfer agents useful in this invention can be represented by the structure I:

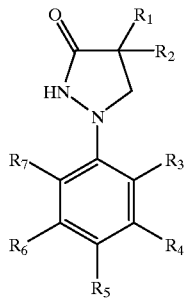

wherein $R_1$ and $R_2$ are independently hydrogen or a substituted or unsubstituted alkyl group having 1 to 6 carbon atoms (such as methyl, ethyl, isopropyl, t-butyl, n-hexyl, chloromethyl, dichloromethyl, hydroxymethyl, 2-hydroxyethyl, sulfomethyl, and sulfonamido). Preferably, at least one of $R_1$ and $R_2$ is a substituted alkyl group having from 1 to 6 carbon atoms, and more preferably, at least one of them is a hydroxyalkyl having 1 to 6 carbon atoms. Most preferably, at least one of them is hydroxymethyl. Where $R_1$ and $R_2$ are substituted groups, useful substituents include halo, hydroxy, alkoxy, acyloxy, aryloxy, keto, sulfonamnido, carbonamido, carbamyl, carboxy and sulfo groups.

Also in structure I, $R_3$, $R_4$, $R_5$, $R_6$ and $R_7$ are independently hydrogen, halo, a substituted or unsubstituted alkyl group (as defined above), a substituted or unsubstituted alkoxy group having 1 to 6 carbon atoms, sulfonamido (including alkylsulfonamido), sulfamyl, halo (such as chloro), amino (including alkyl- or acetyl-substituted amino and sulfoalkyl- and carboxyalkylamino), acyloxy, amido, aryloxy, keto, an ester, carbonamido, carbamyl, carboxy, sulfo, sulfoalkyl or carboxyalkyl, wherein the alkyl portion of such groups is defined above. Preferably, one or more of $R_3$ through $R_7$ is hydrogen, alkyl or alkoxy as defined above. More preferably, at least one of them is hydrogen.

Compounds useful in the practice of this invention include, but are not limited to, 4-methyl-4-hydroxymethyl-1-phenyl-3-pyrazolidone, 1-phenyl-3-pyrazolidone, 4,4-dimethyl-1-phenyl-3-pyrazolidone, 4,4-dihydroxymethyl-1-phenyl-3-pyrazolidone, 4,4-dihydroxymethyl-1-p-tolyl-3-pyrazolidone, 4-hydroxymethyl-4-methyl-1-p-tolyl-3-pyrazolidone, 4-hydroxymethyl-4-methyl-1-o-tolyl-3-pyrazolidone, 4,4-diethyl-1-phenyl-3-pyrazolidone, 4-methyl-4-propyl-1-p-aminophenyl-3-pyrazolidone, 4-methyl-4-propyl-1-p-chlorophenyl-3-pyrazolidone, 4,4-diethyl-1-p-acetamidophenyl-3-pyrazolidone, 4,4-dimethyl-1-p-β-hydroxyethylphenyl-3-pyrazolidone, 4,4-dimethyl-1-p-hydroxyphenyl-3-pyrazolidone, 4,4-diethyl-1-p-methoxyphenyl-3-pyrazolidone, 4,4-dimethyl-1-p-tolyl-3-pyrazolidone, 4-methyl-4-hydroxymethyl-1-(3,5-dimethyl)phenyl-3-pyrazolidone, 1-(p-methoxyphenyl )-3-pyrazolidone, 4-methyl-4-hydroxymethyl-1-(p-methoxyphenyl)-3-pyrazolidone, 3-[3-(4-hydroxymethyl-4-methyl-3-oxopyrazolidin-1-yl) phenylamino] propanesulfonic acid, or tetraethylammonium 2-[4-(4-hydroxymethyl-4-methyl-3-oxopyrazolidin-1-yl) phenylcarbamoyl]-benzenesulfonate.

A mixture of such compounds can be used in the color developing composition if desired. The first compound listed above is most preferred.

The color developing compositions useful in the practice of this invention include one or more color developing agents that are well known in the art that, in oxidized form, will react with dye forming color couplers in the processed materials. Such color developing agents include, but are not limited to, aminophenols, p-phenylenediamines (especially N,N-dialkyl-p-phenylenediamines) and others which are well known in the art, such as EP 0 434 097A1 (published Jun. 26, 1991) and EP 0 530 921A1 (published Mar. 10, 1993). It may be useful for the color developing agents to have one or more water-solubilizing groups as are known in the art. Further details of such materials are provided in *Research Disclosure*, publication 38957, pages 592–639 (Sep. 1996). *Research Disclosure* is a publication of Kenneth Mason Publications Ltd., Dudley House, 12 North Street, Emsworth, Hampshire PO10 7DQ England (also available from Emsworth Design Inc., 121 West 19th Street, New York, N.Y. 10011). This reference will be referred to hereinafter as "*Research Disclosure*".

Preferred color developing agents include, but are not limited to, N,N-diethyl p-phenylenediamine sulfate (KODAK Color Developing Agent CD-2), 4-amino-3-methyl-N-(2-methane sulfonamidoethyl)aniiline sulfate, 4-(N-ethyl-N-β-hydroxyethylamino)-2-methylaniline sulfate (KODAK Color Developing Agent CD4), p-hydroxyethylethylaminoaniline sulfate, 4-(Nethyl-N-2-methanesulfonylaminoethyl)-2-methylphenylenediamine sesquisulfate (KODAK Color Developing Agent CD-3), 4-(N-ethyl-N-2-methanesulfonylaminoethyl)-2-methylphenylene-diamine sesquisulfate, and others readily apparent to one skilled in the art.

In order to protect the color developing agents from oxidation, one or more antioxidants are generally included in the color developing compositions. Either inorganic or organic antioxidants can be used. The organic antioxidants are preferred. Many classes of useful antioxidants are known, including but not limited to, sulfites (such as sodium sulfite, potassium sulfite, sodium bisulfite and potassium metabisulfite), hydroxylamine (and derivatives thereof), hydrazines, hydrazides, amino acids, ascorbic acid (and derivatives thereof), hydroxamic acids, aminoketones, mono- and polysaccharides, mono- and polyamines, quaternary ammonium salts, nitroxy radicals, alcohols, and oximes. Also useful as antioxidants are 1,4-cyclohexadiones as described in copending and commonly assigned U.S. Ser. No. 091123,976 (filed Jul. 29, 1998 by Qiao and McGarry). Mixtures of compounds from the same or different classes of antioxidants can also be used if desired.

Especially useful antioxidants are hydroxylamine derivatives as described for example, in U.S. Pat. No. 4,892,804 (Vincent et al), U.S. Pat. No. 4,876,174 (Ishikawa et al), U.S.

Pat. No. 5,354,646 (Kobayashi et al), and U.S. Pat. No. 5,660,974 (Marrese et al), and U.S. Pat. No. 5,646,327 (Bums et al), the disclosures of which are all incorporated herein by reference. Many of these antioxidants are mono- and dialkylhydroxylamines having one or more substituents on one or both alkyl groups. Particularly useful alkyl substituents include sulfo, carboxy, amino, sulfonamido, carbonamido, hydroxy and other solubilizing substituents.

More preferably, the noted hydroxylamine derivatives can be mono- or dialkylhydroxylamines having one or more hydroxy substituents on the one or more alkyl groups. Representative compounds of this type are described for example in U.S. Pat. No. 5,709,982 (Marrese et al), incorporated herein by reference, as having the structure II:

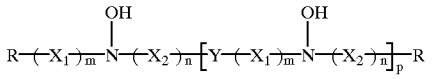

wherein R is hydrogen, a substituted or unsubstituted alkyl group of 1 to 10 carbon atoms, a substituted or unsubstituted hydroxyalkyl group of 1 to 10 carbon atoms, a substituted or unsubstituted cycloalkyl group of 5 to 10 carbon atoms, or a substituted or unsubstituted aryl group having 6 to 10 carbon atoms in the aromatic nucleus.

$X_1$ is —$CR_9(OH)CHR_8$—and $X_2$ is —$CHR_8CR_9(OH)$— wherein $R_8$ and $R_9$ are independently hydrogen, hydroxy, a substituted or unsubstituted alkyl group or 1 or 2 carbon atoms, a substituted or unsubstituted hydroxyalkyl group of 1 or 2 carbon atoms, or $R_8$ and $R_9$ together represent the carbon atoms necessary to complete a substituted or unsubstituted 5- to 8-membered saturated or unsaturated carbocyclic ring structure.

Y is a substituted or unsubstituted alkylene group having at least 4 carbon atoms, and has an even number of carbon atoms, or Y is a substituted or unsubstituted divalent aliphatic group having an even total number of carbon and oxygen atoms in the chain, provided that the aliphatic group has a least 4 atoms in the chain.

Also in Structure II, m, n and p are independently 0 or 1. Preferably, each of m and n is 1, and p is 0.

Specific di-substituted hydroxylamine antioxidants include, but are not limited to: N,N-bis(2,3-dihydroxypropyl)hydroxylarnine, N, N-bis(2-methyl-2,3-dihydroxypropyl)hydroxylamine and N,N-bis(1-hydroxymethyl-2-hydroxy-3-phenylpropyl)hydroxylamine. The first compound is preferred.

Many of the noted antioxidants (organic or inorganic) are either commercially available or prepared using starting materials and procedures described in the references noted above in describing hydroxylamines.

Buffering agents are generally present in the color developing compositions to provide or maintain desired alkaline pH of from about 7 to bout 13, and preferably from about 8 to about 12. Such useful buffering agents include, but are not limited to, carbonates, borates, tetraborates, glycine salts, triethanolamine, diethanolamine, phosphates and hydroxybenzoates. Alkali metal carbonates (such as sodium carbonate, sodium bicarbonate and potassium carbonate) are preferred. Mixtures of buffering agents can be used if desired.

In addition to buffering agents, pH can also be raised or lowered to a desired value using one or more acids or bases. It may be particularly desirable to raise the pH by adding a base, such as a hydroxide (for example sodium hydroxide or potassium hydroxide).

The color developing compositions can also include one or more of a variety of other addenda that are commonly used in color developing compositions, including alkali metal halides (such as potassium chloride, potassium bromide, sodium bromide and sodium iodide), metal sequestering compositions (such as polycarboxylic or aminopolycarboxylic acids or polyphosphonates with lithium, magnesium or other small cations), antifoggants, development accelerators, glycols, alcohols, optical brighteners (such as triazinylstilbene compounds), wetting agents, fragrances, stain reducing agents, surfactants, defoaming agents, and water-soluble or water-dispersible color couplers, as would be readily understood by one skilled in the art [see for example, *Research Disclosure*, noted above]. The useful and optimal amounts of such additives are well known in the art also. Representative color developing compositions useful in the practice of this invention are described below in Examples 1–3.

The color developing composition can be provided as a single- or multi-part composition, and can also be a liquid or solid component of a photographic processing kit.

The following TABLE I shows the general and preferred amounts of essential components of the color developing compositions. The preferred ranges are listed in parentheses ( ), and all of the ranges are considered to be approximate or "about" in the upper and lower end points. During color development, the actual concentrations can vary depending upon extracted chemicals in the composition, replenishment rates, water losses due to evaporation and carryover from any preceding processing bath and carryover to the next processing bath.

TABLE I

| COMPONENT | CONCENTRATIONS |
|---|---|
| Color developing agent | 1–45 mmol/l (4.5–22 mmol/l) |
| Antioxidant | 2–90 mmol/l (20–45 mmol/l) |
| 3-Pyrazolidone electron transfer agent | 0.2–10 mmol/l (1–14 mmol/l) |
| Buffering agent | 36–420 mmol/l (100–300 mmol/l) |

The color developing composition described herein have utility to provide color development in an imagewise exposed color photographic papers comprising a support and one or more silver halide emulsion layers containing an imagewise distribution of developable silver halide emulsion grains in each of three color records. A wide variety of types of photographic papers containing various types of emulsions can be processed using the present invention, the types of elements being well known in the art (see *Research Disclosure*, noted above). In particular, the invention can be used to process color photographic papers of all types of emulsions including so-called "high chloride" and "low chloride" type emulsions, and so-called tabular grain emulsions as well.

The present invention is particularly useful to process high chloride (greater than 70 mole % chloride and preferably greater than 90 mole % chloride, based on total silver) emulsions in color photographic papers in a rapid fashion. Such color photographic papers can have any useful amount of silver coated in the one or more emulsions layers, and in some embodiments, low silver (that is, less than about 0.8 g silver/$m^2$, and preferably less than 0.6 g silver/$m^2$) elements are processed with the present invention. The layers of the photographic elements can have any useful binder material or vehicle as it known in the art, including various gelatins and other colloidal materials.

Color development of an imagewise exposed photographic silver halide paper is carried out by contacting the element with a color developing composition prepared according to this invention under suitable rapid time and temperature conditions, in suitable processing equipment, to produce the desired color balanced image. Additional processing steps can then be carried out using conventional procedures, including but not limited to, one or more development stop, bleaching, fixing, bleach/fixing, washing (or rinsing) and drying steps, in any particular desired order as would be known in the art. Useful processing steps, conditions and materials useful therefor are well known for the various processing protocols steps (other than color development) including the conventional Process RA4 (see for example, *Research Disclosure*, noted above, and the references noted therein, and U.S. Pat. No. 4,892,804, also noted above.

The photographic papers processed in the practice of this invention are multilayer color elements that typically contain dye image-forming color records sensitive to each of the three primary regions of the visible spectrum. Each color record can be comprised of a single emulsion layer or multiple emulsion layers sensitive to a given region of the spectrum. The color records of the element can be arranged in any of the various orders known in the art. The elements can also contain other conventional layers such as filter layers, interlayers, subbing layers, overcoats and other layers readily apparent to one skilled in the art. A magnetic backing can be included on the backside of conventional supports.

Considerably more details of the color paper structure and components are described in *Research Disclosure*, noted above. Included within such teachings in the art is the use of various classes of cyan, yellow and magenta color couplers that can be used with the present invention (including pyrazolone type magenta dye forming couplers). Such papers generally have pigmented resin-coated paper supports which are prepared with the usual internal and external sizing agents (including alkylketene dimers and higher fatty acids), strengthening agents and other known paper additives and coatings.

The color developing compositions described herein can also be used in what are known as redox amplification processes, as described for example, in U.S. Pat. No. 5,723,268 (Fyson) and U.S. Pat. No. 5,702,873 (Twist).

Processing according to the present invention can be carried out using conventional deep tanks holding processing solutions. Alternatively, it can be carried out using what is known in the art as "low volume thin tank" processing systems, or LVTT, which have either a rack and tank or automatic tray design. Such processing methods and equipment are described, for example, in U.S. Pat. No. 5,436,118 (Carli et al) and publications noted therein.

Color development is generally followed by a bleaching and fixing steps or a bleach/fixing step using a suitable silver bleaching agent to desilver the color developed color paper. Numerous bleaching agents are known in the art, including hydrogen peroxide and other peracid compounds, persulfates, periodates and ferric ion salts or complexes with polycarboxylic acid chelating ligands. Particularly useful chelating ligands include conventional polyaminopolycarboxylic acids including ethylenediaminetetraacetic acid and others described in *Research Disclosure*, noted above, U.S. Pat. No. 5,582,958 (Buchanan et al) and U.S. Pat. No. 5,753,423 (Buongiome et al). Biodegradable chelating ligands are also desirable because the impact on the environment is reduced. Useful biodegradable chelating ligands include, but are not limited to, iminodiacetic acid or an alkyliminodiacetic acid (such as methyliminodiacetic acid), ethylenediaminedisuccinic acid and similar compounds as described in EP-A-0 532,003, and ethylenediamine monosuccinic acid and similar compounds as described in U.S. Pat. No. 5,691,120 (Wilson et al), or any mixture thereof.

The processing time and temperature used for each processing step (except color development) of the present invention are generally those conventionally used in the art. Color development is generally carried out at a temperature of from about 20 to about 60° C. (preferably from about 30 to about 45° C.). The overall color development time is generally at least 10 seconds, and preferably at least 12 seconds, and generally up to 25 seconds, and preferably up to 20.

The following, examples are provided for illustrative purposes only and are not intended to be limiting in any way. Unless otherwise indicated, all percentages are by weight.

COMPARATIVE EXAMPLE 1

The developer composition (D1) shown in TABLE II allows a shorter development time for KODAK EKTACOLOR EDGE 5 Color Paper compared with that normally used in EKTACOLOR RA-Prime Developer that is described below as "Normal Process: 45 sec".

TABLE II

| COMPONENT | AMOUNT |
|---|---|
| Pentasodium salt of diethylenetriaminepentaacetic acid (40%) | 9.6 ml/l |
| Potassium carbonate | 33 g/l |
| Sodium salt of p-toluene sulfonic acid | 20 g/l |
| Polyethylene glycol 4000 | 10 g/l |
| N-isopropyl-N-(sulfoethyl)hydroxylamine | 8.0 g/l |
| PHORWITE REU ® optical brightener | 2.0 g/l |
| Potassium chloride | 4.0 g/l |
| KODAK Color Developing Agent CD-3 | 8 g/l |
| Triazolium thiolate* | 0.1 g/l |
| pH | 10.0 |
| Temperature | 41° C. |

*4-carboxyethyl-2,3-dimethyl-1,2,4-triazolium-5-thiolate

The sensitometric results for a process cycle shown in TABLE III, are shown in the following TABLE IV.

TABLE III

| Normal Process cycle | Short Process cycle |
|---|---|
| EKTACOLOR RA-Prime: 45 seconds | Developer DI: 12, 14 or 16 seconds |
| Bleach-fix: 45 seconds | Bleach-fix: 45 seconds |
| Wash: 2 minutes | Wash: 2 minutes |

Bleach-fixing was carried out using EKTACOLOR RA-4 Bleach-fix.

TABLE IV

| | Normal Process (45 seconds) | | | Short Process (12 seconds) | | |
|---|---|---|---|---|---|---|
| | Red | Green | Blue | Red | Green | Blue |
| Dmax | 2.59 | 2.66 | 2.48 | 2.93 | 2.83 | 1.84 |
| Dmin | 0.107 | 0.098 | 0.108 | 0.108 | 0.101 | 0.102 |
| Contrast | 3.00 | 3.32 | 3.35 | 3.28 | 3.31 | 2.10 |

In this example it can be seen that the short process is high in red-sensitive color record and green-sensitive color record Dmax and contrast but low in blue-sensitive color record Dmax and contrast relative to the normal process. This is the problem that is solved by the present invention.

COMPARATIVE EXAMPLE 2

In order to lower the red- and green-sensitive color record contrast, shoulder and Dmax in the short process cycle described in Comparative Example 1, a development inhibitor was added to Developer D1 of TABLE II. Ranges of concentrations of 5-methyl-benzotriazole (BTAZ) were as follows: 0, 5, 20 and 100 mg/l (0, 0.037 mmol/l, 0.15 mmol/l and 0.75 mmol/l) were added to the developer and the sensitometric responses were measured. The results from processing samples of KODAK EKTACOLOR EDGE 5 Color Paper are shown in TABLE V.

TABLE V

| BTAZ (mg/l) | 0 | 5 | 20 | 100 | RA-ref |
|---|---|---|---|---|---|
| Red Dmax | 2.953 | 2.908 | 2.547 | 0.974 | 2.629 |
| Green Dmax | 2.821 | 2.792 | 2.398 | 0.632 | 2.649 |
| Blue Dmax | 2.266 | 1.997 | 1.326 | 0.407 | 2.468 |
| Red Dmin | 0.116 | 0.11 | 0.105 | 0.103 | 0.105 |
| Green Dmin | 0.117 | 0.104 | 0.103 | 0.103 | 0.097 |
| Blue Dmin | 0.125 | 0.115 | 0.104 | 0.102 | 0.11 |
| Red speed | 141.7 | 137.1 | 110.6 | | 129.6 |
| Green speed | 130.2 | 125 | 96.2 | | 122.8 |
| Blue speed | 126.1 | 116.9 | 61.3 | | 123.1 |
| Red contrast | 4.188 | 3.928 | 2.646 | 0.845 | 3.265 |

TABLE V-continued

| BTAZ (mg/l) | 0 | 5 | 20 | 100 | RA-ref |
|---|---|---|---|---|---|
| Green contrast | 3.411 | 3.403 | 2.945 | 0.585 | 3.241 |
| Blue contrast | 3.068 | 2.343 | 1.29 | 0.31 | 3.325 |
| Red shoulder | 2.196 | 2.126 | 1.775 | | 1.937 |
| Green shoulder | 1.996 | 1.992 | 1.804 | | 1.95 |
| Blue shoulder | 1.787 | 1.53 | 1.198 | | 1.928 |
| Red toe | 0.349 | 0.336 | 0.37 | | 0.325 |
| Green toe | 0.364 | 0.343 | 0.385 | | 0.314 |
| Blue toe | 0.341 | 0.369 | 0.669 | | 0.295 |

It can be seen from TABLE V that 5-methyl benzotriazole (BTAZ) was effective in lowering red- and green-sensitive color record response as required, and a level between 5 and 20 mg/liter will bring these responses close to the aim response listed under RA-ref. At the same time however the blue-sensitive color record response is inhibited even more than the red- and green-sensitive color records, even at the lowest level of 5-methyl benzotriazole. This is not desired because the blue-sensitive color record response is already underactive in the short process and now in the presence of a commonly used inhibitor exhibits even more unacceptable sensitometry.

This example shows that a commonly used inhibitor cannot correct the overactivity in the red- and green-sensitive color record without also severely upsetting the blue-sensitive color record response and giving unsatisfactory performance in the short process. Other materials commonly used as inhibitors and restrainers such as 6-nitrobenzimidazole, 1- phenyl-5-mercaptotetrazole, potassium bromide and iodide behave in the same way as 5-methylbenzotriazole. Thus some other way to restore the color balance by lowering red- and green-sensitive color record activity without inhibiting blue-sensitive color record activity is needed. This is the problem solved by the present invention.

EXAMPLE 1

This is an example of the invention.

In this example the same developer as shown in TABLE II was used except that 0.5 g/1 (2.4 mmol/l) of 4-methyl4hydroxymethyl-1-phenyl-3-pyrazolidone (MOP) was added to the developer as an electron transfer agent. The results from processing KODAK EKTACOLOR EDGE 5 Color Paper samples compared with the "normal process" and the "short process" (as described above) without MOP are shown in TABLE VI.

TABLE VI

| | Normal Process (45 seconds) | | | Short Process (12 seconds) +MOP | | | Short Process (12 seconds) no MOP | | |
|---|---|---|---|---|---|---|---|---|---|
| | Red | Green | Blue | Red | Green | Blue | Red | Green | Blue |
| Dmax | 2.59 | 2.66 | 2.48 | 2.45 | 2.68 | 2.19 | 2.93 | 2.83 | 1.84 |
| Dmin | 0.107 | 0.098 | 0.108 | 0.103 | 0.096 | 0.095 | 0.108 | 0.101 | 0.102 |
| Contrast | 3.00 | 3.32 | 3.35 | 2.97 | 3.30 | 2.90 | 3.28 | 3.31 | 2.10 |

It can be seen that the effect of MOP is to lower red- and green-sensitive color record Dmax and red-sensitive color record contrast compared to the short process without MOP so that these parameters are now very close to those for the normal process. The second effect of MOP is to increase the blue-sensitive color record response in terms of Dmax (+19%) and contrast (+38%) relative to the short process in the absence of MOP. The third effect of MOP is to lower Dmin density in all color records. The net effect of MOP is to restore the color balance in the short process. This complex and beneficial effect of MOP is an entirely unexpected result and could not be foreseen from the known behavior of MOP and other 3-pyrazolidones in color development. In general MOP and other 3-pyrazolidones act as development accelerators and have been found to act as boosters for the bottom or blue-sensitive color record in color paper. This has been observed for color paper based on silver bromochloride emulsions but the simultaneous reduction of the red- and green-sensitive color record responses has not been observed. This would appear to be a new observation for color paper based on essentially pure silver chloride emulsions as opposed to silver bromochlorides.

EXAMPLE 2

This is another example of the invention

Figure 2:
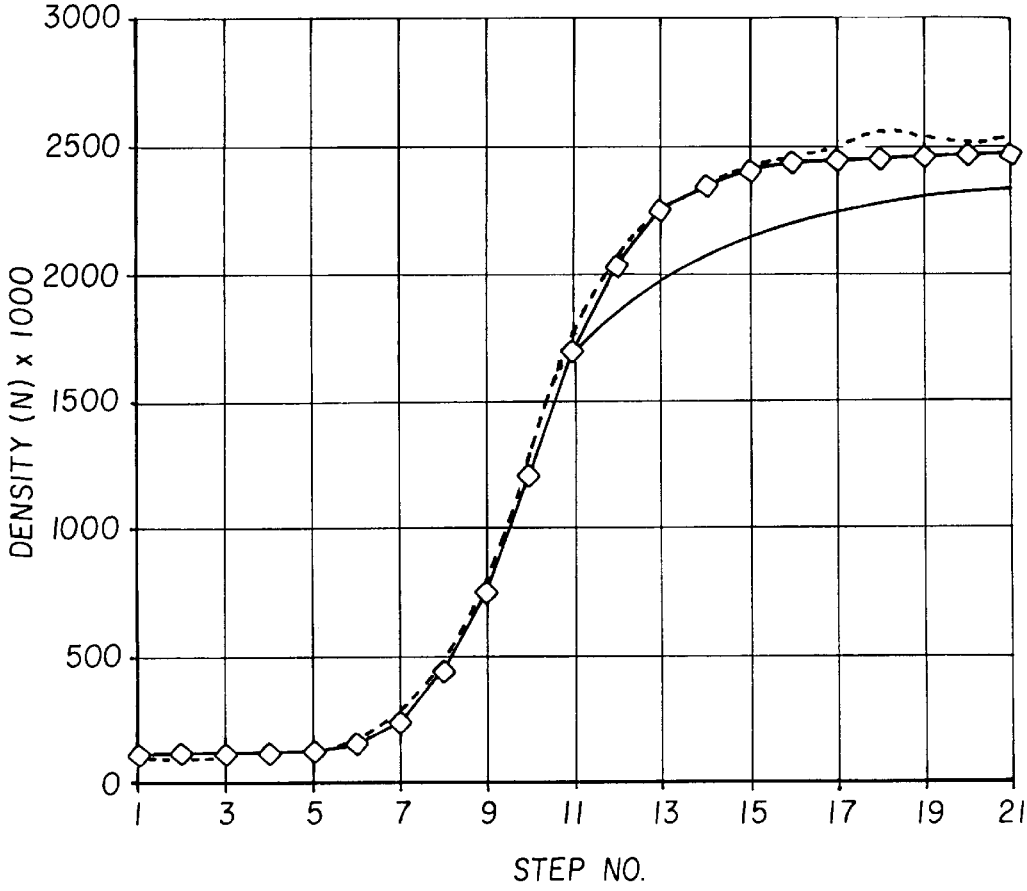
FIG. 2 is a graphical plot of sensitometric results in the blue-sensitive color record of the processed color papers as described in Example 2 below.

In this example the Developer D1 in TABLE II was reformulated to 10 g/l of KODAK Color Developing Agent CD-3 and used at 45° C. The red- and blue-sensitive color record sensitometric results with and without MOP are shown in FIGS. 1 and 2, respectively. The solid lines with points (diamonds) are the RA-ref curves, the solid lines without points are the curves for the short 14 second color development without MOP and the dashed curves are for the short 14 second color development with MOP.

In these Figures it can be seen that the high activity in the red-sensitive color record and the low activity in the blue-sensitive color record mentioned in Comparative Example 1 are also present in this example using a reformulated color developer and both of these detrimental effects are corrected by the addition of MOP at 0.3 g/l (1.46 mmol/l). The resulting sensitometric curves for the short 14 second color development are a close match to the aim reference curves ("RA-ref") for the standard 45 second color development. This means that the practice of the invention allows the use of a single color paper in either or both of the rapid and conventional processes.

EXAMPLE3

This is still another example of the invention.

Figure 3:
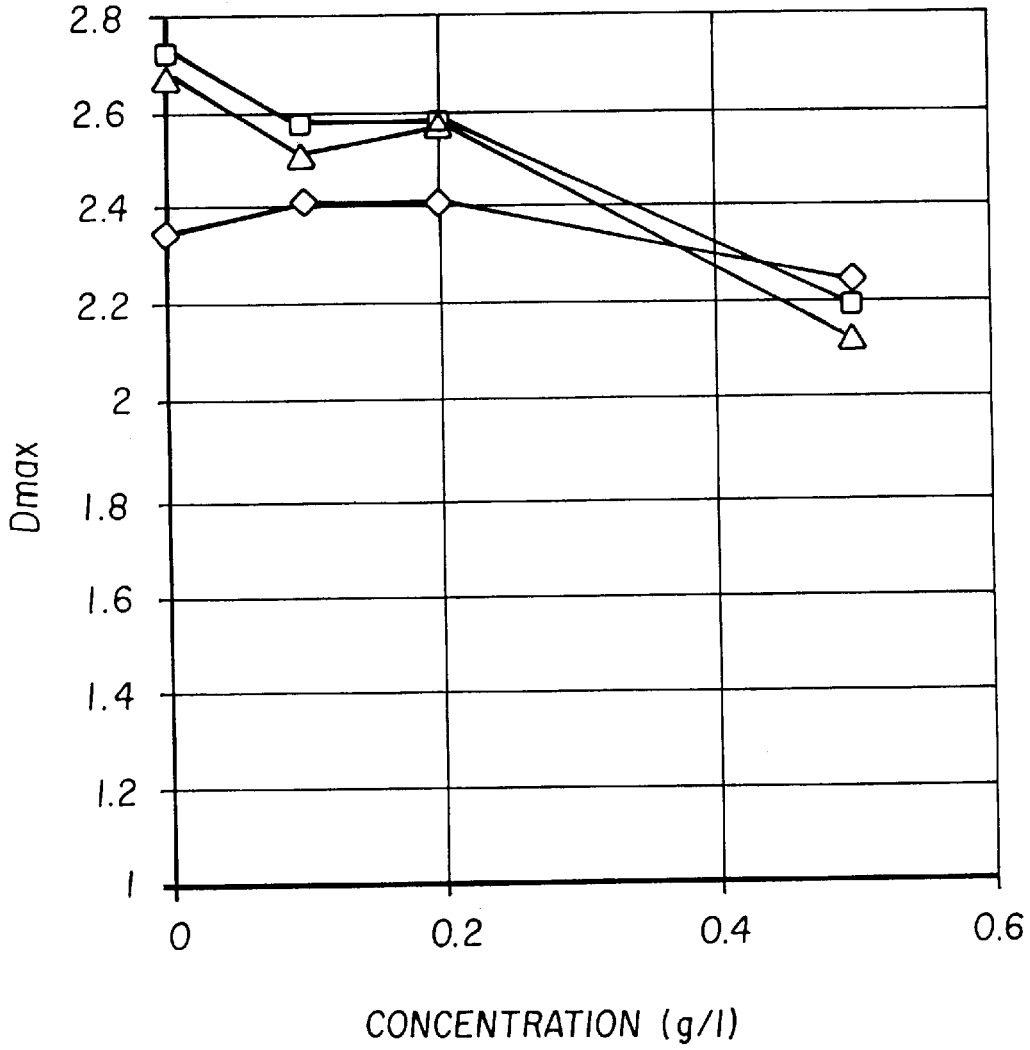
FIG. 3 is a graphical plot of the effect of ETA concentration on Dmax for all three color records as described in Example 3 below.

In this example the same color developer described in TABLE II was used with the addition of 1 phenyl-pyrazolidone (PHENIDONE®) as an electron transfer agent at 0, 0.1, 0.2 to 0.5g/l (or 0, 0.62 mmol/l, 1.24 mmol/l, 3.1 mmol/l). The color paper processed was KODAK EKTA-COLOR EDGE 7 Color Paper and the color development time was 16 seconds. It can be seen from FIG. 3 that the effect of PHENEDONE® electron transfer agent is similar to that of MOP in that the red-sensitive color record (curve with squares) and green-sensitive color record (curve with triangles) Dmax density values are reduced and the blue-sensitive color record (curve with diamonds) Dmax density is increased at low PHENEDONE® levels. The net effect was to correct the color balance as was found with MOP.

The invention has been described in detail with particular reference to preferred embodiments thereof, but it will be understood that variations and modifications can be effected within the spirit and scope of the invention.

I claim:

1. A method of forming a color photographic image comprising:

A) contacting an imagewise exposed color silver halide photographic paper with a color developing composition comprising a color developing agent, and a 3-pyrazolidone electron transfer agent in an amount of at least 0.2 mmol/l, said contacting being for up to 25 seconds, said photographic paper comprising a support having thereon, in order, a blue-sensitive photographic silver halide emulsion layer, a green-sensitive photographic silver halide emulsion layer, and a red-sensitive photographic silver halide emulsion layer, wherein desired color balance among all three silver halide emulsion layers is maintained.

2. The method of claim 1 wherein said contacting step is carried out within from about 10 to about 25 seconds.

3. The method of claim 2 wherein said contacting step is carried out within from about 12 to about 20 seconds.

4. The method of claim 1 further comprising:

B) desilvering said color developed photographic paper.

5. The method of claim 1 wherein said electron transfer agent is represented by the structure I:

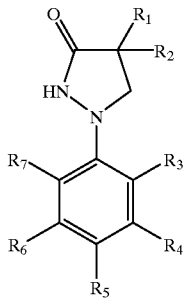

wherein $R_1$ and $R_2$ are independently hydrogen or an alkyl group, and $R_3$, $R_4$, $R_5$, $R_6$ and $R_7$ are independently hydrogen, an alkyl group, an alkoxy group, sulfonamido, sulfamyl, amino, acyloxy, amido, aryloxy, keto, halo, an ester, carbonamido, carbamyl, carboxy, sulfo, sulfoalkyl or carboxyalkyl.

6. The method of claim 5 each of $R_1$ and $R_2$ is substituted or unsubstituted alkyl.

7. The method of claim 6 wherein $R_1$ is an alkyl of 1 to 6 carbon atoms, and $R_2$ is an hydroxyalkyl of 1 to 6 carbon atoms.

8. The method of claim 4 wherein one or more of $R_3$ to $R_7$ is hydrogen, an alkyl group of 1 to 6 carbon atoms, or an alkoxy group of 1 to 6 carbon atoms.

9. The method of claim 1 wherein said electron transfer agent is 4-methyl-4-hydroxymethyl-1-phenyl-3-pyrazolidone, 1-phenyl-3-pyrazolidone, 4,4-dimethyl-1-phenyl-3-pyrazolidone, 4,4-dihydroxymethyl-1-phenyl-3-pyrazolidone, 4,4-dihydroxymethyl-1-p-tolyl-3-pyrazolidone, 4-hydroxymethyl-4-methyl-1-p-tolyl-3-pyrazolidone, 4-hydroxymethyl-4-methyl-1-o-tolyl-3-pyrazolidone, 4,4-diethyl-1-phenyl-3-pyrazolidone, 4-methyl-4-propyl-1-p-aminophenyl-3-pyrazolidone, 4-methyl4-propyl-1-p-chlorophenyl-3-pyrazolidone, 4,4-diethyl-1-p-acetamidophenyl-3-pyrazolidone, 4,4-dimethyl-1-p-β-hydroxyethylphenyl-3-pyrazoli done, 4,4-dimethyl-1-p-hydroxyphenyl-3-pyrazolidone, 4,4-diethyl-1-p-methoxyphenyl-3-pyrazoli done, 4,4-dimethyl-1-p-tolyl-3-pyrazolidone, 4-methyl-4-hydroxymethyl-1-(3,5-dimethyl)phenyl-3-pyrazolidone, 1-(p-methoxyphenyl)-3-pyrozolidone, 4-methyl-4-hydroxymethyl-1-(p-methoxyphenyl)-3-pyrazolidone, 3-[3-(4-hydroxymethyl-4-methyl-3-oxopyrazolidin-1-yl) phenylamino]propanesulfonic acid, or tetraethylammonium 2-[4-(4-hydroxymethyl-4-methyl-3-oxopyrazolidin-1-yl) phenylcarbamoyl]-benzenesulfonate.

10. The method of claim 9 wherein said electron transfer agent is 4-methyl-4-hydroxymethyl-1-phenyl-3-pyrazolidone.

11. The method of claim 1 wherein said color developing agent is present in said color developing composition in an amount of from about 1 to about 45 mmol/l, and said electron transfer agent is present in an amount of from about 0.2 to about 10 mmol/l.

12. The method of claim 1 wherein said color developing composition further comprises an antioxidant in an amount of from about 2 to bout 90 mmol/l.

13. The method of claim 11 wherein said color developing composition comprises a hydroxylamine antioxidant.

14. The method of claim 12 wherein said color developing composition comprises a dialkylhydroxylamine that has at least one hydroxy, sulfo, carboxy, sulfonamido, sulfamoyl, carbonamido or carbamoyl group.

15. The method of claim 13 wherein said dialkylhydroxylamine has at least one alkyl group substituted with one or more sulfo, carboxy or hydroxy groups.

16. The method of claim 13 wherein said hydroxylamine antioxidant is N,N-bis(2,3-dihydroxypropyl) hydroxylamine.

17. The method of claim 1 wherein said color developing agent is 4-(N-ethyl-N-2-methanesulfonylaminoethyl)-2-methylphenylenediamine sesquisulfate.

18. The method of claim 1 wherein color development is carried out at a temperature of from about 20 to about 60° C.

19. A method of forming a color photographic image comprising:

A) contacting an imagewise exposed color silver halide photographic paper with a color developing composition comprising from about 1 to about 45 mmol/l of 4-(N-ethyl-N-2-methanesulfonylaminoethyl)-2-methylphenylene-diamine sesquisulfate, from about 2 to about 90 mmol/l of N,N-bis(2,3-dihydroxypropyl) hydroxylamine, and 4-methyl-4-hydroxymethyl-1-phenyl-3-pyrazolidone in an amount of from about 0.2 to 10 mmol/l, said contacting being for up to 25 seconds, said photographic paper comprising a support having thereon, in order, a blue-sensitive photographic silver halide emulsion layer, a green-sensitive photographic silver halide emulsion layer, and a red-sensitive photographic silver halide emulsion layer, wherein desired color balance among all three silver halide emulsion layers is maintained.

20. The method of claim 19 wherein said color photographic paper comprises a silver halide emulsion having at least 70 mol % chloride, based on total silver, and a total silver coverage of 0.8 g silver/$m^2$ or less.

* * * * *